United States Patent [19]

Carrara

[11] 3,978,815

[45] Sept. 7, 1976

[54] CONTINUOUS CASTING APPARATUS WITH AN ARTICULATIVE SEALING CONNECTION

[75] Inventor: Marcel Vincent Carrara, Schenectady, N.Y.

[73] Assignee: General Electric Company, New York, N.Y.

[22] Filed: Dec. 22, 1975

[21] Appl. No.: 642,771

[52] U.S. Cl. ..... 118/69; 65/32; 118/405; 164/275; 277/30; 432/242

[51] Int. Cl.[2] ..... B05C 3/12

[58] Field of Search ..... 118/404, 405, 429, 50, 118/DIG. 18, 69; 164/275; 266/3 R; 432/242; 277/30; 65/32, 134, 157; 34/242; 427/431–434

[56] References Cited

UNITED STATES PATENTS 3,060,054 10/1962 Russell et al. ..... 118/405 X 3,233,834 2/1966 Cottrell et al. ..... 277/30 X

*Primary Examiner*—Morris Kaplan

*Attorney, Agent, or Firm*—R. G. Simkins; P. L. Schlamp; F. L. Neuhauser

[57] ABSTRACT

Apparatus for a process of continuously casting metals by passing a metal core member upwardly through a container of molten metal, and thereby accreting and solidifying molten metal on the core member. The invention comprises an articulative sealing connection for adjoining a tiltable casting crucible in a continuous casting system with a fixed cooling chamber wherein the crucible top surface is in part spherical and slidable with respect to the tubular end section extending from the cooling chamber.

6 Claims, 1 Drawing Figure

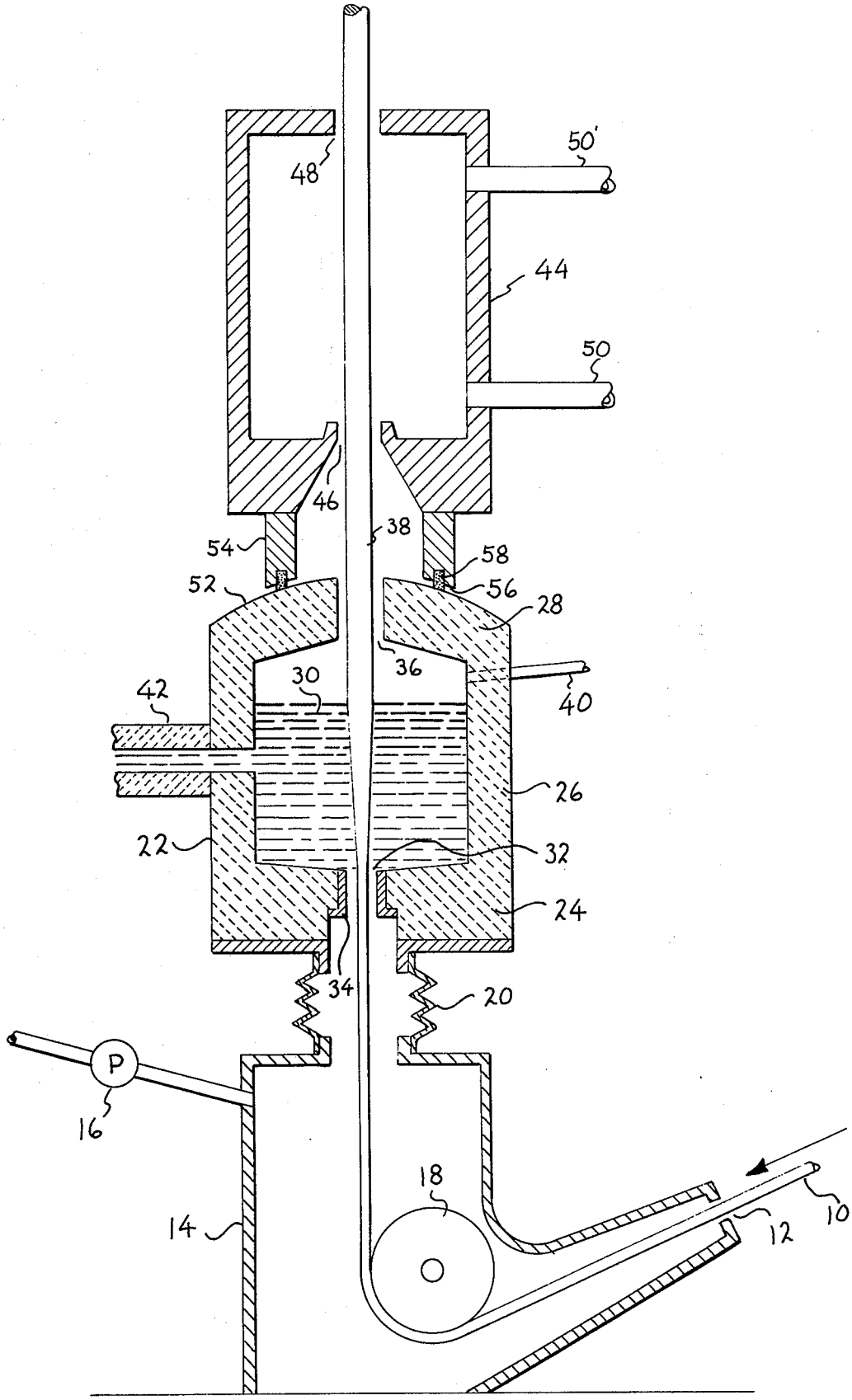
50'
48
44
50
46
38
54
58
52
56
28
36
30
42
40
26
22
32
24
34
20
P
16
18
14
12
10

CONTINUOUS CASTING APPARATUS WITH AN ARTICULATIVE SEALING CONNECTION

BACKGROUND OF THE INVENTION

This invention relates to an improvement in apparatus for a method of continuously casting metal according to the so-called "Dip-Forming Process" of casting metal. The Dip-Forming system for the continuous casting of metal comprises supplying a body of molten metal and passing a metal core member through the molten metal and thereby accreting and solidifying molten metal on the core member.

The Dip-Forming Process of continuously casting by means of moving a core member through a body of molten metal, and apparatus therefor, are the subject of many prior U.S. patents, including:

| | | |
|---|---|---|
| 3,008,201 | 3,235,960 | 3,598,085 |
| 3,060,053 | 3,424,130 | 3,610,204 |
| 3,060,054 | 3,466,186 | 3,709,722 |
| 3,060,055 | 3,484,280 | 3,813,260 |
| 3,060,056 | 3,510,345 | 3,866,570 |
| 3,094,752 | 3,538,884 | 3,924,,036 |

The disclosures of these U.S. patents are incorporated herein by reference.

Molten metal handling devices such as melting furnaces, pouring furnaces or ladles, and crucibles, provided with pivotal mounts or other movable supports to enable their tilting or a change of inclination for the purpose of regulating the supply or flow of their molten contents have not been generally suitable or adaptable for use in the Dip-Forming Process for continuous casting of the prior art and as heretofore practiced for several reasons. The Dip-Forming Process for continuous casting requires a series of continuously and sequentially executed and coordinated steps or operations, including the continuous upward passage of a metal core member or "seed rod" through a casting crucible containing the melt for casting which is preceded by a necessary preparation of the metal core member or seed rod for casting of the melt thereon and then succeeded by a necessary cooling of the hot cast product. Moreover, in casting high grade copper rod stock suitable for use in the manufacture of electrical conductors and service as such, which constitutes the primary utilization of the Dip-Forming Process, a protective or non-oxidizing atmosphere or environment is necessary substantially through the entire casting process or system, including the preceding preparational operations which comprise the essential initial removal of oxides and any foreign material from the metal core member and the succeeding conclusional operations which comprise the cooling of very hot solidifying cast metal to impart thereto adequate integrity and strength for subsequent handling.

SUMMARY OF THE INVENTION

This invention provides for the utilization of tiltable molten metal handling means such as melting furnaces, pouring furnaces and casting crucibles for the regulation of the melt supply or flow in a dip-form continuous casting system in conjunction with cooperating rigidly positioned apparatus whereby the necessary continuous sequence of operations, including the performance of both the pre-casting and post-casting requirements, as well as the casting step, are all carried out in a protective atmosphere. The invention specifically includes an articulating connection which operatively adjoins a tiltable casting crucible or other molten metal receptacle with adjacent fixed mechanisms, such as a cooling chamber, in a sealing relationship excluding the ambient atmosphere, and maintains its sealing effect during the tilting movement of the crucible and in turn during the articulation of the connection, or at any operative position of the casting crucible.

OBJECTS OF THE INVENTION

A primary object of this invention is to provide apparatus for the dip-form of continuous casting which advantageously and effectively includes a tiltable casting crucible or other molten metal receptical for improved control over the supply or flow of the melt.

It is also an object of this invention to provide an articulating joint for operatively connecting a movable casting crucible with a fixed cooling chamber.

It is a further object of this invention to provide an articulating connection between a tiltable casting crucible and an unmovable cooling chamber in a dip-form continuous casting system which effectively seals out and excludes the outer atmosphere and any of its contents from the interior of the system and maintains its sealing effect during movement of the tiltable casting crucible and while residing at any predesigned operating position.

BRIEF DESCRIPTION OF THE DRAWING

The drawing comprises a schematic cross-sectional view of a portion of the dip-form system for continuous casting illustrating the articulative sealing connection of this invention operatively adjoining a movable enclosed casting furnace with an unmovable enclosed cooling chamber in a sealing relationship.

DETAILED DESCRIPTION OF A PREFERRED EMBODIMENT

Referring to the drawing, there is shown a schematic illustration in cross-section of the principal segments of the overall Dip-Forming system and apparatus for continuous casting of the prior art, including means for the preparation of the metal core member for casting thereon, melt casting, and cooling of the cast metal product.

In the drawing, a metal core member 10, such as a rod of copper or a copper alloy, is continuously advanced into the system and passed upward through the principal operations and means therefor. The cast product derived therefrom, or a segment thereof, may thereafter be returned and recycled one or more times through the system following drawing to reduce its diameter to the size of a core member for use as a seed rod, or the cast product, or a segment thereof, can be removed from the system in accordance with the prior art practices as shown in the above cited U.S. patents.

Prior to casting thereon, the surface of core member 10 must be cleaned of any oxides or foreign contaminants which may interfere with the casting. Suitable cleaning means include an annular cutting device which peels away a thin portion of the surface area of the core member as it continuously advances therethrough, reducing it to a predetermined diameter for subsequent passage through the system. The surface cleaning of the core member 10 is preferably achieved as the core member enters into a series of communicating and atmosphere precluding enclosures which house the means for carrying out the continuous casting operation, such as at the entry 12 of the casting crucible vestibule or antechamber 14 whereby the cleaning means such as an annular cutting device can also conveniently function as an entry seal.

Antechamber 14 consists of a substantially air tight enclosure or series of connected enclosures provided with means to substantially exhaust the atmospheric air or other unwanted gases therefrom, such as an evacuating connection and pump 16. Antechamber 14 is also suitably provided with means for appropriately aligning the core member 10 for passage through the system upwardly in a substantially vertical direction, such as one or more direction reversing pulley 18, and may include rod straightening means. The antechamber structure is preferably rigedly secured in an unmovable position whereby it is operatively connected by means of an atmosphere excluding, flexible conduit 20 to the movable casting crucible 22.

Casting crucible 22 comprises an enclosed refractory chamber including a bottom wall 24, side wall 26 and top wall 28, suitable for the containment of molten metal 30 such as copper or an alloy of copper exclusive of the ambient atmosphere. Crucible 22 includes an entry port 32 in the bottom wall 24 thereof, provided with a replaceable bushing insert 34, and an exit port 36 in the top wall 28 thereof for the continuous upward passage of core member 10 therethrough and its molten metal 30 contents for the casting of the melt by accretion and solidification thereon to produce, upon emerging from the melt, the cast product 38 consisting of the core member with the cast metal thereon.

Enclosed casting crucible 22 is also preferably provided with a gas inlet conduit 40 for the supply of an apt protective gas, such as nitrogen or a reducing gas, from a suitable source thereof, and a molten metal feed or supply inlet 42 in a side wall thereof. Feed inlet 42 can be supplied with melt from any suitable source such as a melting furnace or pouring furnace communicating with or adjoiningly affixed thereto.

In accordance with this invention the enclosed casting crucible 22 is pivotally mounted to enable its tilting or inclining from a substantially vertical position as a means of controlling the supply of molten metal thereto from its source such as an adjoining furnace through feed inlet 42. For example, casting crucible 22 can be mounted on trundles or other pivoting supports providing a fulcrum point in a lower region thereof such as approximately at the entry port 32 in its bottom wall whereby the casting crucible can be tilted or inclined back and forth over an arcuate course which raises and lowers the feed inlet 42 to regulate the flow of the molten metal into the crucible without significantly dislocating the generally vertically upwardly path or course of travel of the metal core member passing upward from the antechamber 14 into the casting crucible 22.

Suspended above the tiltable casting crucible 22 is an enclosed cooling chamber for the cooling of the hot cast product 38 of the melt accreted and solidified on the core member 10 passing continuously upwardly through the molten metal casting crucible 22. A lower entry opening 46 and an upper exit opening 48 are provided in the cooling chamber 44 for the continuous upward passage of the core member 10 forming with the melt accreted and solidified thereon, the cast product 38. Cooling chamber 44 is enclosed to protect the as yet very hot, recently cast metal from the atmosphere and confine the cooling medium, and is provided with suitable connections, such as conduits 50 and 50' for the flow therein of a suitable fluid cooling medium such as water or other liquid coolants.

As provided by this invention, an articulative sealing connection is formed to operatively adjoin or unite the exit port 36 in the top of the tiltable enclosed casting crucible 22 with the lower entry opening 46 of the unmovable enclosed cooling chamber 44 in a sealed or atmosphere excluding relationship to enable the continuous passage of the core member 10, and cast product 38 embodying said core member, upwardly through the casting crucible 22 and therefrom into and through the cooling chamber 44 exclusive of the ambient atmosphere. Moreover, the articulating sealing connection of this invention maintains the sealing relationship of excluding the ambient atmosphere from the interior portions of the casting crucible and cooling chamber of the casting system including the intermediate area embracing the path of travel of the core member and cast product thereof from the casting crucible exit 36 to the cooling chamber entry opening 46 during movement of the tiltable enclosed casting crucible 22 on its pivotal mount and also while residing in any operative position within the course of its movement.

The articulative sealing connection of this invention comprises an outer spherical surface 52 on the top wall 28 of the tiltable enclosed casting crucible 22 which extends around or surrounds the exit portion 36 therein. Preferably, the exit port 36 should be approximately centered in the spherical surface 52 of the crucible top wall to provide for the maximum extent of movement while preserving the sealing effect.

The lower entry opening 46 of the enclosed cooling chamber 44 is provided with a shroud-like depending annular skirt or lip 54 of relatively large diameter in relation to the area of the crucible's exit port 36 and which extends from the cooling chamber entry opening down to and surrounds the crucible's exit port 36 through the operable range of movement of the tiltable casting crucible on its pivotal mount and also in any other operable positions within the course of its range of movement. Depending annular skirt or lip 54 is constructed with the annular edge 56 of its lower end in circumferential sealing contact with the face of the spherical surface 52 whereby an atmosphere excluding seal is provided. Also, this sealing relationship of the circumferential sealing contact is maintained during the movement of the casting crucible on its pivotal mount within the range of the tilting arc provided by the size of the spherical surface of the casting crucible top and of the depending annular lip, and while the casting crucible resides in any operable position or angle of inclination within said range.

The articulative sealing connection of this invention thus provides an articulating joint which operatively unites an enclosed casting crucible which is movable through a tilting arc and a rigidly fixed or unmovable enclosed cooling chamber and sealingly excludes the ambient atmosphere therefrom. The arc of inclination for tilting the casting crucible from vertical may be up to 10 degrees, or more, in either direction (+10 to −10 degrees), while retaining the sealing relationship of excluding atmospheric gases and contaminants.

Also, the articulative sealing connection of this invention is amenable to construction with high temperature stable materials, for example refractories and heat resistant metals such as stainless steel, and/or the installation of cooling means such as circulating cooling fluids, whereby the connection will effectively function at the very high temperature conditions encountered with the melt and casting crucible over long periods of service and without heat damage.

To insure the effectiveness of the circumferential seal provided by the annular edge 56 of the lip in cooperation with the spherical surface 52 of the top of the enclosed casting crucible, it is preferred that a positive pressure be maintained within the upper region of the interior of the continuous casting system. For example, an inert or reducing gas medium providing a protective blanket over the melt 30 can be applied, such as from a source through a flexible inlet conduit 40, at a sufficient pressure and quantity so as to permit its passage up through the casting crucible exit port 36 about the cast product 38 and into the area defined by lip 54 at a moderate positive pressure which will effectively preclude the entry of ambient gases. Alternatively, a protective gas can be applied directly to the area defined by lip 54 from a supply.

Also, to enhance the sealing effect of the annular edge 56 of the lip 54 in cooperation with the spherical surface 52, or to minimize the mechanical precision of their adjoining surface, or compensate for surface wear, a resilient sealing material or body 58, such as refractory fiber, can be installed within the edge 56, for example, a replacable seal inserted within a recess provided in the edge of the lip.

The arrangement provided by this invention is advantageously and uniquely suitable for use in the dip-forming system for continuous casting. For instance, the locating of the fulcrum point of the pivotally mounted and tiltable enclosed casting crucible at about the level or location of the entry port of the casting crucible does not discernibly divert or dislocate the course of the generally vertical upward passage of the relatively rigid metal core member until after its entry into the casting crucible and its rapid heating therein by the solidification of the accreted melt thereon. Thus, when the pivotally mounted casting crucible is tilted and the system thereafter operated by continuously casting with the casting crucible in a tilting or inclined position of up to several degrees from vertical in either direction, the cast product 38 comprising the rod member 10 with the accreted melt 30 solidified thereon emerging from the casting crucible exit port is at a very high temperature and heat softened whereby it is very pliable and easily conforms to a dislocated or diverted course. Thus, wherein the continuously advancing rod member is least amenable to bending or diversion in its course of travel, the means of this invention cause a minimum of dislocation therein by shifting or relocating the location of the maximum dislocation of the continuously advancing rod member or the cast product embodying the same, to a stage or operation wherein it is most amenable to bending or diversion in its course of travel.

Although the invention has been described with reference to certain specific embodiments thereof, numerous modifications are possible and it is desired to cover all modifications falling within the spirit and scope of this invention.

What I claim as new and desire to secure by Letters Patent of the United States is:

1. Apparatus for the continuous casting of metal by passing a metal core member upwardly through a body of molten metal and thereby accreting and solidifying molten metal on the core member, comprising:

a. a tiltable enclosed casting crucible for the containment of molten metal having an entry port in a bottom wall thereof and an exit port in a top wall thereof for the passage of a metal core member upwardly through the enclosed crucible and molten metal contents thereof to thereby cast the molten metal by accretion and solidification on the core member, said enclosed casting crucible being pivotally mounted for tilting and having a feed inlet in a side wall thereof for the addition of molten metal into the casting crucible whereby the supply of molten metal into the casting crucible can be controlled by tilting the pivotally mounted casting crucible;

b. an enclosed cooling chamber suspended above the tiltable enclosed casting crucible having a lower entry opening and an upper exit opening for the passage of a metal core member with cast metal accreted and solidified thereon from the casting crucible upwardly through the enclosed cooling chamber for the cooling thereof; and, c. an articulative sealing connection operatively adjoining the exit port in the top of the tiltable enclosed casting crucible with the lower entry opening of the enclosed cooling chamber for the passage of a metal core member upwardly through the tiltable casting crucible and therefrom into and through the cooling chamber, said articulative sealing connection comprising the combination of the tiltable casting crucible top wall having an outer spherical surface extending around the exit port therein and the cooling chamber lower entry opening having a depending annular lip of relatively large diameter surrounding the casting crucible exit port and in circumferential slidable sealing contact with the spherical surface of the top wall thereof whereby the sealing connection adjoining the casting crucible exit port and the cooling chamber entry opening for the passage of the core member upwardly therethrough is maintained while tilting the casting crucible on its pivotal mount.

2. The continuous casting apparatus of claim 1, wherein a lower annular edge of the depending annular lip is provided with an annular recess containing an annular resilient seal therein for circumferential sealing contact with the spherical surface of the top of the enclosed casting crucible.

3. Apparatus for the continuous casting of metal by passing a metal core member upwardly through a body of molten metal and thereby accreting and solidifying molten metal on the core member, comprising:

a. a tiltable enclosed casting crucible for the containment of molten metal having an entry port in the bottom wall thereof and an exit port in a top wall thereof for the passage of a metal core member substantially vertically upward through the enclosed crucible and molten metal contents thereof to thereby cast the molten metal by accretion and solidification on the core member, said enclosed casting crucible being pivotally mounted for tilting and having a feed inlet in a side wall thereof for the addition of molten metal into the casting crucible whereby the supply of molten metal into the casting crucible can be controlled by tilting the pivotally mounted casting crucible;

b. an enclosed cooling chamber suspended above the tiltable casting crucible having a lower entry opening surrounding the exit port in the top of the casting crucible and an upper exit opening for the passage of a metal core member with cast metal accreted and solidified thereon from the casting crucible substantially vertically upward through the enclosed cooling chamber for cooling thereof; and, c. an articulative sealing connection operatively adjoining the exit port in the top of the tiltable enclosed casting crucible with the lower entry opening of the cooling chamber suspended thereover for the passage of a core member substantially vertically upward through the tiltable enclosed casting crucible and therefrom into and through the enclosed cooling chamber, said articulative sealing connection comprising the combination of the tiltable casting crucible top wall having an outer spherical surface extending around the exit port therein and the cooling chamber lower entry opening having a depending annular lip member of relatively large diameter surrounding the casting crucible exit port and in circumferential slidable sealing contact with the spherical surface of the top wall surface thereof whereby the sealing connection adjoining the casting crucible exit port and the cooling chamber entry opening for substantially vertical upward passage of the core member therethrough is maintained while tilting the casting crucible on its pivotal mount.

4. The continuous casting apparatus of claim 3, wherein a lower annular edge of the depending annular lip is provided with an annular recess containing an annular resilient seal therein for circumferential sealing contact with the spherical surface of the top of the enclosed casting crucible.

5. Apparatus for the continuous casting of copper metal by passing a copper core member upwardly through a body of molten copper and thereby accreting and solidifying molten copper on the core member, comprising:

a. a tiltable enclosed casting crucible for the containment of molten copper having an entry port in a bottom wall thereof and on exit port in a top wall thereof for the passage of a copper core member substantially vertically upward through the enclosed crucible and molten copper contents thereof to thereby cast the molten copper by accretion and solidification on the copper core member, said enclosed casting crucible being pivotally mounted for tilting and having a feed inlet in a side wall thereof for the addition of molten copper into the casting crucible whereby the supply of molten copper into the casting crucible can be controlled by tilting the pivotally mounted casting crucible;

b. a substantially rigidly positioned enclosed cooling chamber suspended above the tiltable enclosed casting crucible having a lower entry opening surrounding the exit port in the top of the casting crucible and an upper exit opening for the passage of a copper core member with cast copper accreted and solidified thereon from the casting crucible substantially vertically upward through the enclosed cooling chamber for the cooling thereof; and, c. an articulative sealing connection operatively adjoining the exit port in the top of the tiltable enclosed casting chamber with the lower entry opening of the substantially rigidly positioned cooling chamber suspended thereover for the continuous passage of a copper core member substantially vertically upward through the tiltable enclosed casting crucible and therefrom into and through the substantially rigidly positioned enclosed cooling chamber, said articulative sealing connection comprising the combination of the tiltable enclosed casting crucible top wall having an outer spherical surface extending around the exit port therein and the substantially rigidly positioned enclosed cooling chamber lower entry opening having a depending annular lip member of relatively large diameter surrounding the tiltable casting crucible exit port and in circumferential slidable sealing contact with the spherical surface of the top wall thereof whereby the sealing connection adjoining the casting crucible exit port and the cooling chamber entry opening for substantially vertical upward passage of the copper core member therethrough is maintained while tilting the enclosed casting crucible on its pivotal mount.

6. The continuous casting apparatus of claim 5, wherein the lower annular edge of the depending annular lip is provided with an annular recess containing an annular resilient seal therein for circumferential sealing contact with the spherical surface of the top of the enclosed casting crucible.

* * * * *